US006732864B2

(12) United States Patent
Usui

(10) Patent No.: US 6,732,864 B2
(45) Date of Patent: May 11, 2004

(54) METHOD FOR MEASURING STRENGTH OF IMAGE FORMING SURFACE OF PLANOGRAPHIC PRINTING PLATE, PLANOGRAPHIC PRINTING PLATE AND PACKAGING STRUCTURE FOR PLANOGRAPHIC PRINTING PLATES

(75) Inventor: Takayuki Usui, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 253 days.

(21) Appl. No.: 09/955,954

(22) Filed: Sep. 20, 2001

(65) Prior Publication Data

US 2002/0060815 A1 May 23, 2002

(30) Foreign Application Priority Data

Sep. 20, 2000 (JP) ..... 2000-285052

(51) Int. Cl.[7] ..... B65D 85/30
(52) U.S. Cl. ..... 206/455; 73/788
(58) Field of Search ..... 73/788, 818; 206/449, 206/454, 455, 456, 521, 593

(56) References Cited

U.S. PATENT DOCUMENTS 4,336,093 A 6/1982 Kohayakawa et al.
4,934,185 A 6/1990 Nishiyama et al.
6,026,955 A * 2/2000 Dirx ..... 206/455
6,332,537 B1 * 12/2001 Usui et al. ..... 206/521
6,534,234 B1 * 3/2003 Naruse et al. ..... 430/162

FOREIGN PATENT DOCUMENTS

EP 0 528 395 A1 2/1993
EP 0 907 107 A 4/1994
JP 2-25845 1/1990

OTHER PUBLICATIONS

Patent Abstract of Japan 02–025845 Jan. 29, 1990.

* cited by examiner

*Primary Examiner*—Jacob K. Ackun
(74) *Attorney, Agent, or Firm*—Sughrue Mion, PLLC

(57) ABSTRACT

A method for measuring strength of an image forming surface of a planographic printing plate. In this method, an image forming surface of a planographic printing plate is contacted with a non-image forming surface of another planographic printing plate, a weight of predetermined mass is placed thereon, and the planographic printing plates are slid against each other in a direction along the image forming surface. A maximum value of pressure that does not generate damage when applied to the image forming surface of the lower planographic printing plate is used as strength of the image forming surface. By stacking and packaging planographic printing plates having an image forming surface strength of no less than a specified value, damage to the image forming surfaces of the planographic printing plates in a packaged state can be prevented.

14 Claims, 8 Drawing Sheets

METHOD FOR MEASURING STRENGTH OF IMAGE FORMING SURFACE OF PLANOGRAPHIC PRINTING PLATE, PLANOGRAPHIC PRINTING PLATE AND PACKAGING STRUCTURE FOR PLANOGRAPHIC PRINTING PLATES

BACKGROUND OF THE INVENTION

1. Field of the Invention

The present invention relates to a method for measuring strength of an image forming surface of a planographic printing plate, a planographic printing plate and a packaging structure for planographic printing plates.

2. Description of the Related Art

Planographic printing plates, such as photosensitive and heat-sensitive printing plates, have been widely used in plate-making methods (including xerographic plate-making methods) of recent years to facilitate automation of plate-making processes. Planographic printing plates are generally manufactured in the following manner. Surface treatments such as graining, anodizing, silicate treatment and other chemical conversion treatments are administered, alone or in combination, to a support comprising, for example, a sheet-shaped or coiled aluminum plate. Thereafter, a photosensitive or heat-sensitive layer (hereinafter, these layers will be collectively referred to as "applied films", a surface of a support on which an applied film has been applied will be referred to as an "image forming surface", and a surface of a support on which an applied film has not been applied will be referred to as a "non-image forming surface") is applied onto the support and dried, and then the support having the layer applied thereon is cut to a desired size.

The planographic printing plate is subjected to plate-making processings such as exposure, development, gum coating and the like, set into a printer and applied with ink, whereby characters, images or the like are printed on paper.

Sometimes the planographic printing plates are stacked in a thickness direction to form a stacked sheaf so that the planographic printing plates may be handled with greater efficiency. In this case, it is preferable to protect the image forming surfaces (i.e., applied films) of the planographic printing plates by, for example, contacting the image forming surfaces with papers known as "interleaf sheets" and stacking the planographic printing plates so that an interleaf sheet is disposed between each of the planographic printing plates.

Further, there are also cases in which, depending on the type of image forming surface, the image forming surfaces of the planographic printing plates have enough strength to withstand the kinds of damage that present problems in actual use when the planographic printing plates are packaged (or stacked) without interleaf sheets.

However, no quantitative standards or indices for such strengths of image forming surfaces have been proposed.

Also, when planographic printing plates to which interleaf sheets have been contacted to the image forming surfaces of the planographic printing plates are used in automatic plate-making machines, it is necessary to peel the interleaf sheets from the planographic printing plates. Consequently, efficiency of the plate-making operation can be improved when a so-called plate setter or an automatic plate-making machine having an automatic plate-feed function that automatically peels the interleaf sheets from the planographic printing plates and feeds the planographic printing plates is used.

However, when planographic printing plates and interleaf sheets are alternately stacked in a thickness direction to form a stacked sheaf, surfaces (non-contact surfaces) of the interleaf sheets opposite the surfaces that contact the image forming surfaces of the planographic printing plates come into contact with surfaces of the planographic printing plates (an image forming surface in the case of a planographic printing plate having image forming surfaces on both sides thereof, and a non-image forming surface in the case of a planographic printing plate having only one image forming surface) adjacent to the non-contact surfaces of the interleaf sheets. When the non-contact surfaces of the interleaf sheets strongly adhere to these surfaces of the planographic printing plates, the planographic printing plates are supplied without the interleaf sheets having been peeled therefrom, whereby drawbacks sometimes arise such as the automatic plate-feed operation stopping. For example, when a planographic printing plate is raised by the image forming surface thereof being adsorbed, the interleaf sheet protecting the image forming surface of the adjacent planographic printing plate also adheres to the surface of the opposite side of the planographic printing plate and is raised, resulting in both the planographic printing plate and the interleaf sheet being integrally supplied. Further, when the planographic printing plate is raised by the non-image forming surface thereof being adsorbed, there is the potential for the automatic plate-feed operation to be stopped by planographic printing plates and interleaf sheets adhering to the bottom of the raised planographic printing plate and being integrally supplied with the raised planographic printing plate.

Japanese Patent Application Laid-Open (JP-A) No. 2-25845 discloses an interleaf sheet comprising synthetic pulp mixed paper to which heat pressing has been administered. By forming the interleaf sheet in this manner, peelability of the interleaf sheet with respect to the planographic printing plate is improved and damage to the applied film is prevented.

However, since synthetic pulp is itself expensive, the cost of materials for the interleaf sheet becomes high. Further, since it is necessary to manufacture the synthetic pulp by separating it from general paper, manufacturing costs for the interleaf sheets also become high.

If it were possible to determine that the image forming surfaces of the planographic printing plates have a predetermined strength strong enough to withstand damage when packaged without using interleaf sheets, then it would become unnecessary to use the interleaf sheets and the aforementioned drawbacks would be eliminated.

However, as stated previously, because no quantitative standards or indices for such strengths of image forming surfaces have been proposed, at present, planographic printing plates are generally stacked with interleaf sheets disposed between the planographic printing plates in order to more reliably prevent damage to the image forming surfaces of the planographic printing plates.

SUMMARY OF THE INVENTION

In view of the aforementioned facts, it is a first object of the present invention to obtain a method (hereinafter, "the method") for measuring strength of an image forming surface of a planographic printing plate, with the method being for measuring quantitative standard of strength by which it can be determined that the image forming surface of the planographic printing plate will not sustain damage in a packaged state. It is a second object of the present invention to obtain: a method for measuring strength of an image forming surface of a planographic printing plate, with the method being for measuring quantitative standard of strength by which it can be determined that the image forming surface of the planographic printing plate will not sustain damage in a packaged state, even without using interleaf sheets; a planographic printing plate with which damage to an image forming surface thereof in a packaged state can be prevented by strength of the image forming surface being measured by the method for measuring the strength of an image forming surface of a planographic printing plate; and a structure for packaging the planographic printing plates.

The method of the present invention comprises the steps of: contacting, with an image forming surface to be measured, a member expected to contact the image forming surface of the planographic printing plate in a packaged state; sliding, relative to each other and in a direction along the image forming surface, the planographic printing plate including the image forming surface to be measured and the member expected to contact the image forming surface of the planographic printing plate, while a predetermined load is applied to the planographic printing plate and the member in a direction substantially orthogonal to the image forming surface; and thereafter observing the planographic printing plate for the presence of damage to the image forming surface that is measured, and using a maximum value of pressure that does not generate damage when applied to the image forming surface as the strength of the image forming surface of the planographic printing plate.

In the present invention, the image forming surface to be measured is contacted with the member (hereinafter, occasionally referred to as "the contact member") expected to contact the image forming surface of the planographic printing plate in a packaged state. Further, a state is created that approximates a state in which the planographic printing plates are packaged (stacked) by applying a predetermined load to the planographic printing plate and the contact member in a direction substantially orthogonal to the image forming surface. In the packaged state, when the planographic printing plate including the image forming surface to be measured and the contact member are slid in a direction along the image forming surface, the potential for the image forming surface of the planographic printing plate to sustain damage becomes greater. In addition, whether the image forming surface of the planographic printing plate actually sustains damage depends on whether or not the pressure acting on the image forming surface exceeds a predetermined threshold. Therefore, a state in which there is a potential for the image forming surface to sustain damage is created by applying, in a direction substantially orthogonal to the image forming surface, a predetermined load (pressure) to the planographic printing plate and the contact member, and then sliding, relative to each other and in a direction along the image forming surface, the planographic printing plate including the image forming surface to be measured and the contact member.

Thereafter, in the observation step, the image forming surface of the planographic printing plate is observed for the presence of damage, and the maximum value of pressure that does not generate damage when applied to the image forming surface is used as the strength of the image forming surface of the planographic printing plate. That is, the maximum value of pressure that does not generate damage when applied to the image forming surface, even in a state in which there is the potential for the image forming surface to sustain damage, is used as strength of the image forming surface of the planographic printing plate. Moreover, the observation step can also be carried out before various processings for forming an image are administered to the planographic printing plate and directly after the sliding step. However, depending on, for example, the type of planographic printing plate and purpose, the observation step can be carried out after various treatments such as exposure and development have been completed.

In the method of the present invention, the image forming surface strength that becomes an index of whether or not the image forming surfaces will sustain damage when the planographic printing plates are actually packaged can be quantitatively measured. Moreover, because it also becomes possible to achieve an optimal packaging structure in accordance with the type of planographic printing plate on the basis of the measured image forming surface strength, damage to the image forming surface can reliably be prevented.

In the present invention, there are no particular limitations on the contact member, as long as the member is one that is expected to contact the image forming surface in a state in which the planographic printing plates are packaged. For example, in addition to interleaf sheets and protective cardboards (i.e., cardboards disposed between the planographic printing plates at every predetermined number of sheets thereof, or disposed at end surfaces in the stacking direction of the stacked sheaf, to prevent damage to or deformation of the planographic printing plates due to an external force or the like), internal or external packaging materials can be used. Therefore, the contact member is not limited to any of those described above. A planographic printing plate having the same structure as that of the planographic printing plate having the image forming surface to be measured may also be used as the contact member.

By specifying the contact member to be a planographic printing plate having the same structure as the planographic plate having the image forming surface to be measured, the method of the present invention is also specified, and the numerical value of the image forming surface strength is determined by a single standard (i.e., there are not several different values resulting from differences in measurement conditions).

In the method of the present invention, a state is created during measurement that approximates a state in which only the planographic printing plates are stacked without the use of interleaf sheets. Therefore, the image forming surface strength that becomes an index of whether or not the image forming surface will sustain damage can be quantitatively measured. In other words, when the planographic printing plates are stacked and packaged, whether or not damage to the image forming surface can be prevented, even without the use of interleaf sheets, can be specifically determined on the basis of the value of the image forming surface strength. For example, when the planographic printing plates are handled in a state in which they are stacked and packaged, damage to the image forming surfaces thereof can be reliably prevented even without the use of interleaf sheets, as long as the image forming surface strength measured by the method of the present invention is a constant value or higher. Moreover, since the interleaf sheets are not used, the planographic printing plates can be packaged at a low cost. Further, the interleaf sheets are not used when the planographic printing plates are fed by the automatic plate-making mechanism. Therefore, such drawbacks as the interleaf sheets adhering to the non-image forming surfaces of the planographic printing plates and being supplied in a state in which the interleaf sheets and the planographic printing plates have become integrated (non-removal of the interleaf sheets), whereby the plate-feed operation is halted, do not occur. Moreover, since interleaf sheets are not used, the amount of waste after the packaging structure is opened is reduced.

When the value of the image forming surface strength measured by the method of the present invention does not reach the constant value and interleaf sheets are not used, i.e., in cases where there is the potential for the image forming surface to sustain damage, it is still possible to reduce the damage to the image forming surface to the extent that problems are not caused in actual use. Depending on whether the numerical value of the image forming surface strength is large or small, damage to the planographic printing plates can be reduced by, for example, handling the planographic printing plates with care.

Because a planographic printing plate having the same structure as the planographic plate having the image forming surface to be measured is used as the contact member, there is no need to prepare another member as the contact member. For this reason, measurement of the image forming surface strength can be conducted easily.

There are two types of the planographic printing plate: one having an image forming surface on one side only and one having an image forming surface on each side. In a case in which planographic printing plates having an image forming surface on each side are contacted in the contacting step, respective image forming surfaces come into contact with each other. In contrast, planographic printing plates having an image forming surface on one side only are customarily stacked so that each of the image forming surfaces faces one direction. Therefore, it is acceptable if the image forming surface of the planographic printing plate and the non-image forming surface of the same are disposed so as to contact one another.

The planographic printing plate used as the contact member is specifically selected for the purpose of measuring the image forming surface strength in a simple manner. The member to be used in the actual packaging structure of the planographic printing plates is not limited to a planographic printing plate. Namely, in the state in which the planographic printing plates are packaged, the contact member can be, for example, not only a planographic printing plate but an interleaf sheet, protective cardboard, or internal or external packaging material.

When the strength of the image forming surface is no less than 490 Pa, damage to the image forming surface can be reliably prevented by using protective materials for the planographic printing plates, such as interleaf sheets.

Even when the protective materials for the planographic printing plates are not used, damage to the image forming surface can be reduced by handling the planographic printing plates more carefully, since a constant image forming surface strength is ensured.

It is also acceptable to dispose a protective material (such as an interleaf sheet) between each of the planographic printing plates, which have an image forming surface strength of no less than 490 Pa, to form a stacked sheaf. As a result, damage to the image forming surfaces of the planographic printing plates is prevented.

When the strength of the image forming surface is no less than 980 Pa, damage to the image forming surface can be reliably prevented even when the planographic printing plates are handled, for example, in a stacked and packaged state without the use of interleaf sheets.

When the planographic printing plates are actually packaged, sometimes protective materials (interleaf sheets or protective cardboards) for protecting the planographic printing plates are used. Generally, when the protective material contacts the image forming surface of the planographic printing plate, it becomes more difficult for the image forming surface to sustain damage in comparison to when the planographic printing plates contact one another directly (i.e., when non-image forming surfaces or image forming surfaces are disposed adjacent to image forming surfaces). Accordingly, when the strength of the image forming surface is no less than 980 Pa, damage to the image forming surface can be reliably prevented when only the planographic printing plates are stacked. However, even when the protective materials are used in stacking the planographic printing plates, a sufficient value can be ensured as the image forming surface strength to prevent damage to the image forming surfaces.

The planographic printing plates can be fed by an automatic plate-feed mechanism.

When the planographic printing plates are fed by the automatic plate-feed mechanism, it is possible that the interleaf sheets become unnecessary for preventing the image forming surfaces from sustaining damage. For example, such drawbacks as the interleaf sheets adhering to the non-image forming surfaces of the planographic printing plates and being supplied in a state in which the interleaf sheets and the planographic printing plates have become integrated, whereby the plate-feed operation is halted, do not occur.

The planographic printing plates "fed by the automatic plate-feed mechanism" described above include all planographic printing plates manufactured with the assumption that the planographic printing plates will be fed by an automatic plate-feed mechanism, and also all planographic printing plates for which there exists the potential to be supplied by an automatic plate-feed mechanism. Thus, during actual conditions of use, it does not matter whether the planographic printing plates are fed by an automatic plate-feed mechanism or manually.

The image forming surface of the planographic printing plate can comprise a recording layer whose solubility in developer is altered by irradiation with laser light.

Generally, a planographic printing plate having the image forming surface comprising a recording layer is susceptible to damage. However, in the present invention, since the image forming surface strength is no less than 490 Pa (preferably no less than 980 Pa), it is possible to prevent damage to the image forming surfaces without the use of interleaf sheets.

It is possible to record an image directly on the image forming surface of a planographic printing plate having such a recording layer by irradiation with laser light.

The planographic printing plates whose image forming surface strength is no less than 490 (preferably no less than 980) can be stacked to form a stacked sheaf, and the stacked sheaf can be packaged by a packaging member to thereby form a packaging structure for the planographic printing plates. Therefore, it becomes possible to prevent the image forming surfaces from sustaining damage without the use of interleaf sheets. Since interleaf sheets become unnecessary, the packaging structure for the planographic printing plates can be achieved inexpensively. Further, when the planographic printing plates are fed by the automatic plate-feed mechanism, since interleaf sheets are not used, such drawbacks as the interleaf sheets adhering to the non-image forming surfaces of the planographic printing plates and being supplied in a state in which the interleaf sheets and the planographic printing plates have become integrated, whereby the plate-feed operation is halted, do not occur. Moreover, since labor to remove the interleaf sheets also becomes unnecessary, operation efficiency is improved. In addition, since interleaf sheets are not used, the amount of waste after the packaging structure (the packaging member) is opened is reduced.

Specifically, when the stacked sheaf is formed by the planographic plates without using interleaf sheets, direct contact of the planographic printing plates may be established: (1) between respective image forming surfaces; (2) between image forming surfaces and non-image forming surfaces; or (3) between respective non-image forming surfaces. If planographic printing plates having an image forming surface on both sides are used, contacts are always established between image forming surfaces. If planographic printing plates having an image forming surface on one side only are used, contacts are alternately established between image forming surfaces and between non-image forming surfaces, when the printing plates are stacked with each image forming surface alternately facing in opposite directions. Generally, if planographic printing plates having an image forming surface on one side only are used, the printing plates are stacked with every image forming surfaces facing in one direction, so that contacts are established between the image forming surfaces and the non-image forming surfaces.

DESCRIPTION OF THE PREFERRED EMBODIMENTS

Figure 1:
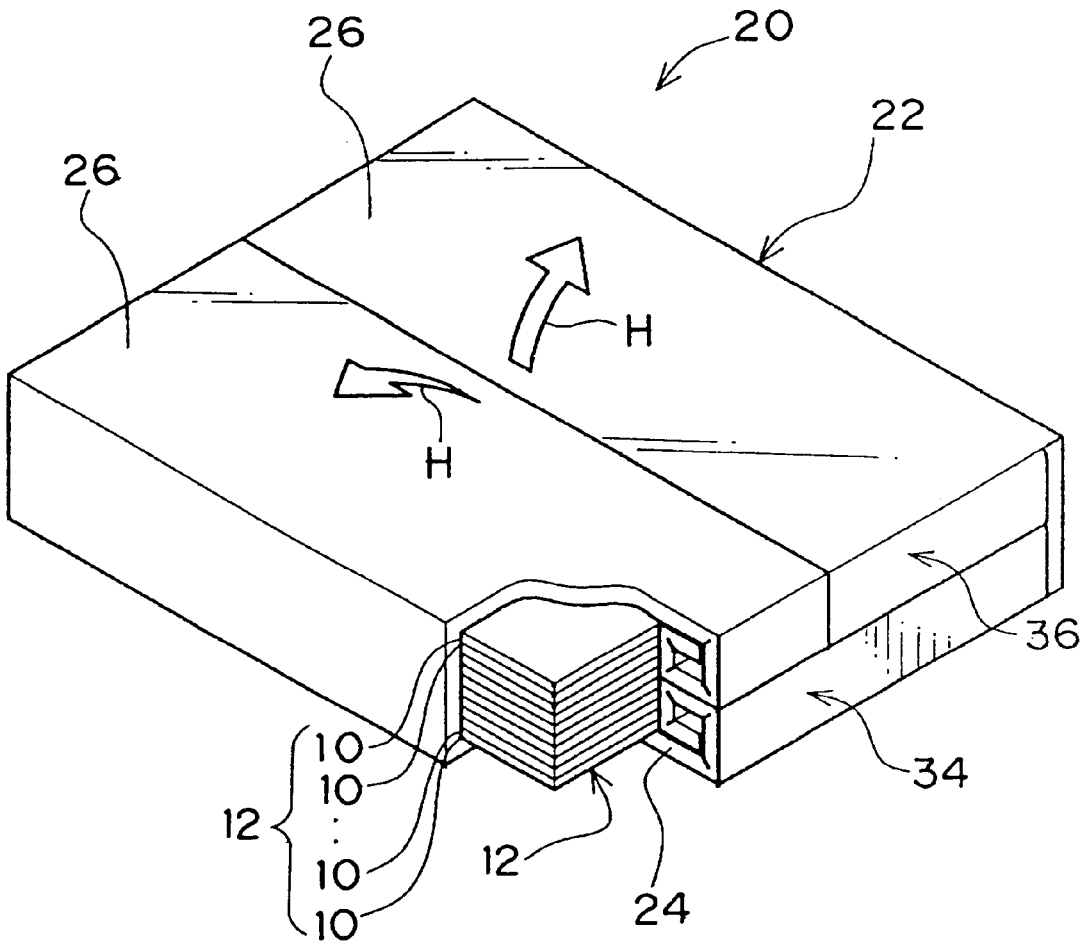
FIG. 1 is a perspective view illustrating a packaging structure for planographic printing plates according to a first embodiment of the present invention, with a portion of a packaging box being cut away.
Figure 3A:
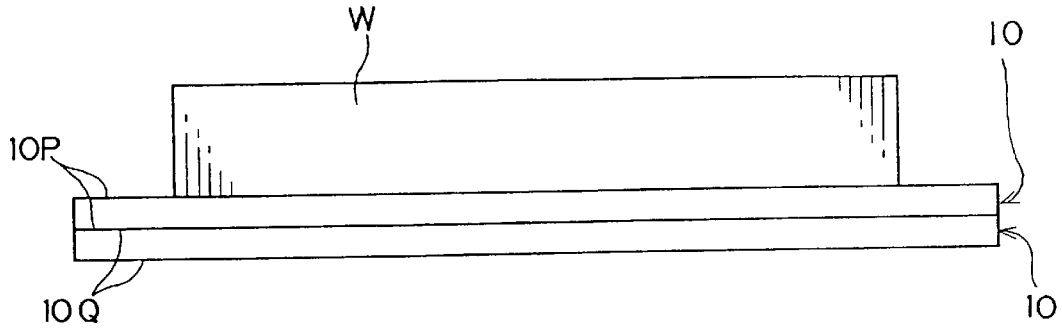
FIG. 3A is a front view illustrating planographic printing plates prior to being slid relative to each other in a method for measuring strength of an image forming surface of a planographic printing plate of the present invention.
Figure 3B:
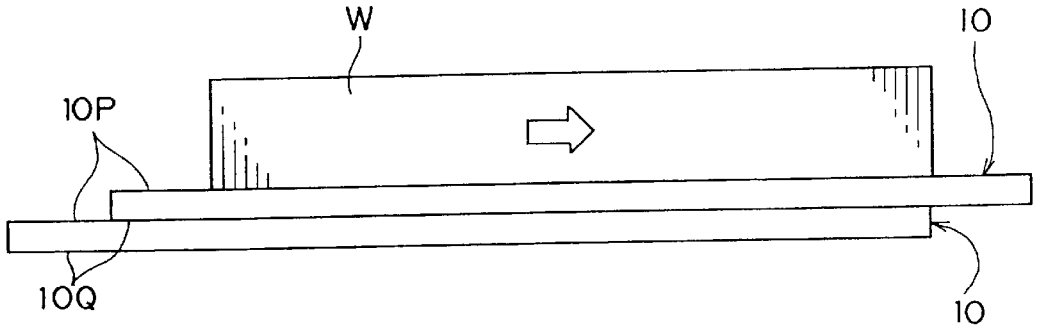
FIG. 3B is a front view illustrating the planographic printing plates after having been slid relative to each other in the method for measuring strength of an image forming surface of a planographic printing plate of the present invention.

FIG. 1 shows a packaging structure 20 for planographic printing plates 10 according to a first embodiment of the present invention. The planographic printing plates 10 are stacked to form a stacked sheaf 12, and the stacked sheaf 12 is packaged in a packaging box 22. FIGS. 3A and 3B show a method for measuring strength of an image forming surface of a planographic printing plate of the present invention (hereinafter, "the method").

The planographic printing plates 10 are formed by applying a film (a photosensitive layer in the case of a photosensitive printing plate and a heat-sensitive layer in the case of a heat-sensitive printing plate) onto a thin aluminum support formed in a rectangular configuration. Thereafter, the planographic printing plate is subjected to plate-making processings such as exposure, development, gum coating and the like, set into a printer and applied with ink, whereby characters, images or the like are printed on paper. Hereinafter, a surface on which a film has been applied will be referred to as an "image forming surface", and a surface on which a film has not been applied will be referred to as a "non-image forming surface". From the standpoint of preventing damage to the aluminum support and preventing the aluminum from melting at the time of development, the non-image forming surface also includes those in which a non-photosensitive or non-heat-sensitive coating solution has been coated to form a film in which an image is not formed.

There are two types of the planographic printing plate 10: one having an image forming surface on one side only and one having an image forming surface on each side. Below, the present invention is described using, by way of example, a planographic printing plate 10 having an image forming surface on one side only. It should also be noted that the planographic printing plate 10 of the present embodiment is one in which processings necessary for printing (e.g., exposure, development, etc.) have not yet been conducted, and that, depending on the situation, the planographic printing plate 10 may be referred to as a planographic printing original plate or a planographic printing plate material.

The specific structure of the planographic printing plate 10 is not limited as long as it has the structure described above. For example, by using a planographic printing plate for heat-mode or photon laser printing, a planographic printing plate can be made directly from digital signals.

Further, by selecting various components within the photosensitive of heat-sensitive layer, it is possible to use as the planographic printing plate 10 planographic printing plates made by various methods of fabrication. Specific examples of the planographic printing plate 10 of the present invention include the following (1) to (11):

(1) a planographic printing plate including a photosensitive layer, with the photosensitive layer including an infrared absorbant, a compound that generates acid by heat, and a compound that crosslinks in the presence of an acid;
(2) a planographic printing plate including a photosensitive layer, with the photosensitive layer including an infrared absorbant and a compound that becomes alkali-soluble due to heat;

(3) a planographic printing plate including a photosensitive layer, with the photosensitive layer comprising two layers, i.e., a layer that includes a compound that generates radicals by irradiation with laser light, a binder soluble in alkali and a polyfunctional monomer or prepolymer, and an oxygen-shielding layer;
(4) a planographic printing plate including a photosensitive layer, with the photosensitive layer comprising two layers, i.e., a physical development core layer and a silver halide emulsion layer;
(5) a planographic printing plate including a photosensitive layer, with the photosensitive layer comprising three layers, i.e., a polymerization layer including a polyfunctional monomer and a polyfunctional binder, a layer including silver halide and a reducer, and an oxygen-shielding layer;
(6) a planographic printing plate including a photosensitive layer, with the photosensitive layer comprising two layers, i.e., a layer including a novolak resin and napthoquinonediazide, and a layer including silver halide;
(7) a planographic printing plate including a photosensitive layer, with the photosensitive layer including an organic photoconductor;
(8) a planographic printing plate including a photosensitive layer, with the photosensitive layer comprising 2–3 layers, i.e., a layer that absorbs laser light and is removed by irradiation with laser light, a lipophilic layer and/or a hydrophilic layer;
(9) a planographic printing plate including a photosensitive layer, with the photosensitive layer including a compound that absorbs energy to release an acid, a polymer compound having on a side chain thereof a functional group that releases sulfonic acid or carboxylic acid in the presence of an acid, and a compound that imparts energy to the acid generator by absorbing visible light;
(10) a planographic printing plate including a photosensitive layer, with the photosensitive layer including a quinondiazide compound and a novolak resin; and
(11) a planographic printing plate including a photosensitive layer, with the photosensitive layer including a compound that is decomposed by light or ultraviolet light to form a crosslinking structure itself or with other molecules within the layer, and a binder soluble in alkali.

Because the image forming surface (photosensitive or heat-sensitive) of a planographic printing plate including a photosensitive layer whose solubility in developer changes by irradiation with laser light easily sustains damage, so-called film cracking (discussed later) can be reliably prevented when the packaging structure of the present invention is applied to the planographic printing plates 10.

The wavelength of the laser light herein is not particularly limited, and examples of the laser include:

(i) lasers in a wavelength region of 350 to 450 nm (e.g., laser diodes having a wavelength of 405±5 nm);
(ii) lasers in a wavelength region of 480 to 540 nm (e.g., argon lasers having a wavelength of 488 nm, (FD) YAG lasers having a wavelength of 532 nm, solid lasers having a wavelength of 532 nm and (green) He-Ne lasers having a wavelength of 532 nm);
(iii) lasers in a wavelength region of 630 nm to 680 nm (e.g., He-Ne lasers having a wavelength of 630 to 670 nm, red semiconductor lasers having a wavelength of 630 to 670 nm);
(iv) lasers in a wavelength region of 800 to 830 nm (e.g., infrared (semiconductor) lasers having a wavelength of 830 nm); and
(v) lasers in a wavelength region of 1064 to 1080 nm (e.g., YAG lasers having a wavelength of 1064 nm).

Among these, either of the lasers having wavelengths described in (ii) or (iii) can be applied to either of the planographic printing plates including the photosensitive or heat-sensitive layers described in (3) or (4) above. Further, either of the lasers having wavelengths described in (iv) or (v) can be applied to either of the planographic printing plates including the photosensitive or heat-sensitive layers described in (1) or (2) above. Of course, the relationship between the wavelength region of the laser light and the photosensitive or heat-sensitive layer is not limited to those described here.

Further, all of the planographic printing plates 10 described in (1) to (11) above are set, in a state in which the planographic printing plates 10 are stacked to form the stacked sheaf 12, in a so-called plate-setter or an automatic plate-making machine having an automatic plate-feed function, and then supplied (fed) to plate-making processings. Thus, according to the planographic printing plate of the present invention, deterioration in the quality of the image forming surface can be reliably prevented in conditions of actual usage without restriction as to whether a user supplies the planographic printing plates 10 by using an automatic plate-feed mechanism or manually (which is a problem with prior methods of plate feeding). Even planographic printing plates other than those described in (1) to (11) above are included in the planographic printing plate 10 of the present invention as long as the planographic printing plate can be set in a so-called plate-setter or an automatic plate-making machine having an automatic plate-feed function, and then supplied (fed) to plate-making processings.

There are not particular limitations on the configuration of the planographic printing plate 10. The planographic printing plate 10 can comprise a photosensitive or heat-sensitive layer coated on one side of an aluminum plate having a thickness of 0.1 to 0.5 mm, a width of 300 to 2050 mm and a length of 200 to 1500 mm.

Further, the planographic printing plate 10 of the present invention has an image forming surface strength, no less than a specific value, measured by the method of the present invention.

As shown in FIGS. 3A and 3B, the method of the present invention is conducted as follows. A planographic printing plate 10 having an image forming surface 10P to be measured and a non-image forming surface 10Q is disposed with the image forming surface 10P facing up. Another planographic printing plate 10 (i.e., a member expected to contact the image forming surface 10P of the planographic printing plate 10 in a packaged state) having an image forming surface 10P and a non-image forming surface 10Q is disposed on top of the planographic printing plate 10 having the image forming surface 10P to be measured. Accordingly, the image forming surfaces 10P of both planographic printing plates 10 face upward and the non-image surface 10Q of the uppermost planographic printing plate 10 (the contact member) comes into contact with the image forming surface 10P of the lowermost planographic printing plate 10.

In this state, a weight W of predetermined mass is placed on the uppermost planographic printing plate 10. The weight W and the uppermost planographic printing plate 10 are integrally slid against the lowermost planographic printing plate 10 in a direction along the image forming surface 10P. (Alternatively, the lowermost planographic printing plate 10 may be relatively slid against the uppermost planographic printing plate 10 and weight W. As long as the plates may be relatively slid against each other, either the uppermost or lowermost planographic printing plate 10 may be slid against the other.) Accordingly, a state is created that approximates a state in which the planographic printing plates 10 are stacked and packaged without the use of protective members such as conventional interleaf sheets, and in which the image forming surface 10P is susceptible to damage.

Thereafter, the lowermost planographic printing plate 10 is removed and observed with the eye (including the use of magnifying instruments such as a loupe) for the presence of damage to the image forming surface 10P. When the image forming surface 10P has sustained damage, so-called film cracking observable by the eye has occurred. It should be noted that, while observation can be carried out immediately after the uppermost planographic printing plate 10 and weight W have been slid against the lowermost planographic printing plate 10 (i.e., prior to administering various processings for image formation to the planographic printing plate 10 having the image forming surface 10P to be measured), observation can be carried out after various processings such as exposure and development, depending on the object and type of planographic printing plate 10.

The above steps are repeated a plurality of times by changing the mass of the weight W. The maximum value of pressure that does not generate damage to the image forming surface 10P when applied thereto is used as the strength of the image forming surface. Thus, image forming surface strength that becomes a standard of whether or not the image forming surface 10P will sustain damage is quantitatively measured by pressure applied to the image forming surface 10P. In other words, with the method of the present invention, when the planographic printing plates 10 are stacked to form the stacked sheaf 12 and the stacked sheaf 12 is packaged, it is possible to specifically determine whether or not damage to the image forming surfaces 10P can be prevented without the use of conventional interleaf sheets, and with what type of handling it is possible to prevent damage to the image forming surface 10P such that problems in actual use do not arise.

When an image forming surface is disposed on both sides of the planographic printing plate 10, image forming surface strength can be measured by contacting the planographic printing plates 10 as shown in FIG. 3 without consideration to which surfaces face up.

In this manner, only planographic printing plates having an image forming surface 10P strength of no less than a predetermined value (980 Pa in the present embodiment) are stacked to form the stacked sheaf 12, which stacked sheaf 12 is then packaged in the packaging box to form the packaging structure 20. There is no limit on the number of planographic printing plates 10 that form a single stacked sheaf 12. However, from the standpoint of transportation and storage efficiency, the number of planographic printing plates 10 that form a single stacked sheaf 12 can be, for example, 10 to 100 sheets. It is also possible to form a stacked sheaf 12 with many planographic printing plates 10 to enable transportation and storage with greater efficiency (i.e., reduce the number of times it is necessary to handle the plates).

The stacked sheaf 12 may also be packaged in, for example, a sheet-like paper (not illustrated) that shields light and is moisture-proof before being packaged in the packaging box 21. By packaging the stacked sheaf 12 in such a sheet-like paper, the planographic printing plates 10 that form the stacked sheaf 12 can be reliably shielded from light and kept free from moisture, and the applied films can be prevented from deteriorating.

Figure 2:
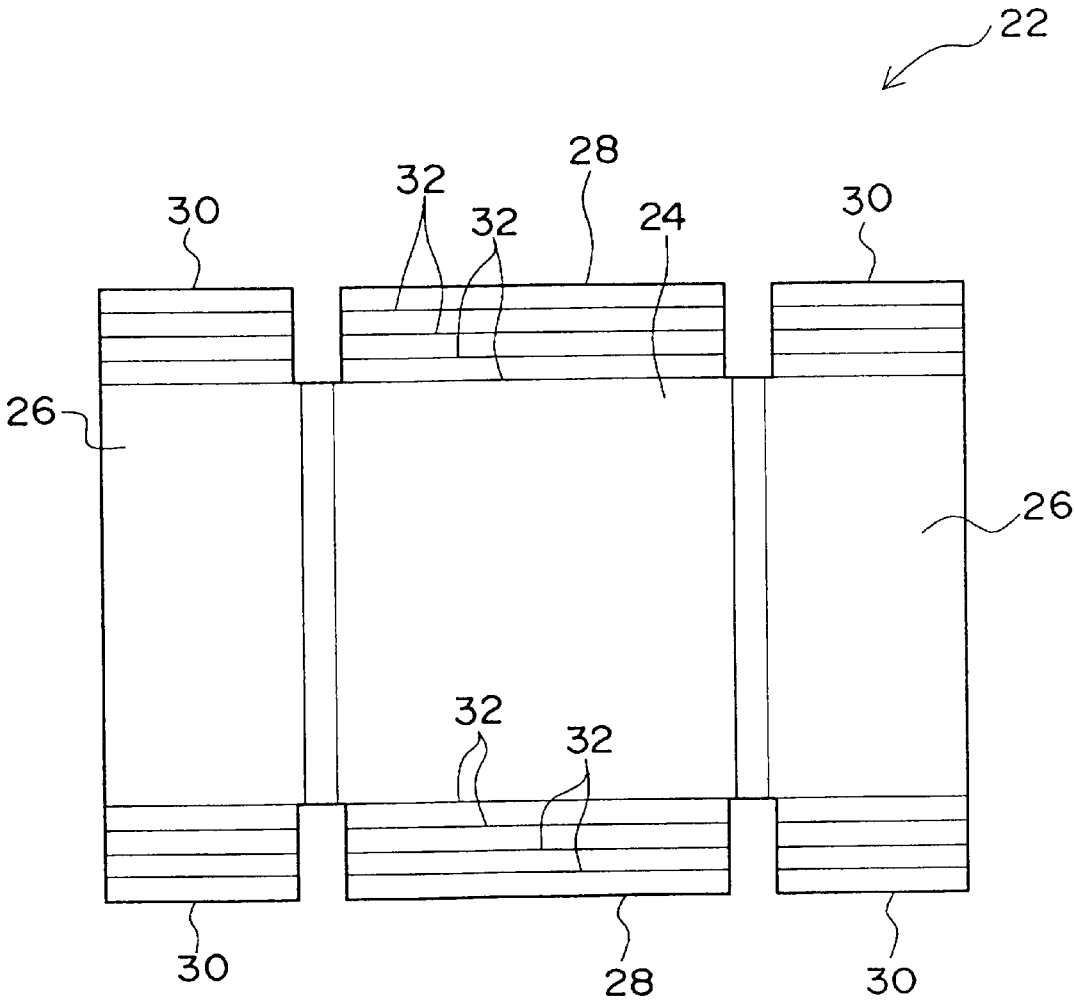
FIG. 2 is a development view illustrating a packaging box for the planographic printing plates that form the packaging structure according to the first embodiment of the present invention.

As shown in FIG. 2, the packaging box 22 is disposed with a bottom panel 24 and top panels 26. At each short end of the bottom panel 24 is disposed a bottom panel folding flap 28, and at each short end of the top panels 26 is disposed a top panel folding flap 30. A plurality of folding lines 32 is formed at the bottom panel folding flaps 28 and at the top panel folding flaps 30. As seen in FIG. 1, by folding the bottom panel folding flaps 28 and the top panel folding flaps 30 at the folding lines 32, spiral-like folded portions 34 and 36 are created. Even if a large, external force acts upon the packaging box 22, the planographic printing plates 10 are reliably protected to the extent that at least damages and deformation that affect quality do not occur. Further, the opening (upper surface) of the packaging box 22 is closed off by the top panels 26. By opening the top panels 26 in the directions indicated by arrows H in FIG. 1, the packaging box 22 is opened, whereby the planographic printing plates 10 can be removed.

Table 1 shows the relationship between values of the image forming surface strength of the planographic printing plates 10 and the presence or absence of damage to the image forming surface 10P, and also the relationship between the presence or absence of interleaf sheets and whether or not the interleaf sheets were removed when the planographic printing plates were set in a machine. "Non-Removal of Interleaf Sheets" means that, when the stacked sheaf 12 is set in a so-called plate-setter or an automatic plate-making machine having an automatic plate-feed function and the planographic printing plates 10 are fed to the automatic plate-making machine, there is the potential for the interleaf sheets to be supplied together with the planographic printing plates 10 and for the plate-feed operation to be halted.

TABLE 1

| | Case 1 | Case 2 | Case 3 | Case 4 |
|---|---|---|---|---|
| Interleaf Sheets | None | None | Present | Present |
| Non-Removal of Interleaf Sheets | Acceptable | Acceptable | Un-acceptable | Un-acceptable |
| Image Forming Surface Strength (Pa) | 980 | 490 | 980 | 490 |
| Damage to Image Forming Surface | Acceptable | Un-acceptable | Acceptable | Acceptable |

In Table 1, "acceptable" indicates that no problems or drawbacks arise, and "unacceptable" indicates the potential for problems and drawbacks to arise.

From Table 1, it will be understood that, with planographic printing plates having an image forming surface strength of 980 Pa, the image forming surfaces 10P do not sustain damage even when interleaf sheets are not used (Case 1). Furthermore, since interleaf sheets are not used, there are no incidents of non-removal of interleaf sheets. In contrast, when planographic printing plates having an image forming surface strength of 490 Pa are stacked and packaged without interleaf sheets (Case 2), there are no incidents of non-removal of interleaf sheets but the image forming surfaces sustain damage. When planographic printing plates having an image forming surface strength of 980 Pa are stacked and packaged with interleaf sheets (Case 3), the image forming surfaces do not sustain damage but there are incidents of non-removal of interleaf sheets. Further, when planographic printing plates having an image forming surface strength of 490 Pa are stacked and packaged using interleaf sheets (Case 4), the image forming surfaces do not sustain damage but there are incidents of non-removal of interleaf sheets.

In the present embodiment, since the stacked sheaf 12 formed by the planographic printing plates 10 that have an image forming surface strength of 980 Pa are packaged by the packaging box 22, the image forming surfaces 10P do not sustain damage from handling. Further, since interleaf sheets are not used, the planographic printing plates 10 can be packaged at a low cost, and when the stacked sheaf 12 is set in a so-called plate-setter or an automatic plate-making machine having an automatic plate-feed function and the planographic printing plates 10 are fed to the automatic plate-feed machine, interleaf sheets are not supplied together with the planographic printing plates 10 to halt the plate-feed operation. Moreover, since labor to remove the interleaf sheets also becomes unnecessary, labor efficiency is improved. In addition, since interleaf sheets are not used, the amount of waste after the packaging structure (the packaging box 22) is opened is reduced.

However, a certain degree of image forming surface strength is ensured even with a planographic printing plate 10 having an image forming surface strength of 490 Pa. Therefore, by handling the planographic printing plates 10 with care, it is possible to prevent damage to the image forming surfaces thereof to the extent that no problems arise in practice use.

It should be noted that the packaging structure of the present invention is not limited to the preceding. Various packaging structures may be employed depending on the quality demanded of the planographic printing plates 10 and conditions of usage.

Figure 4:
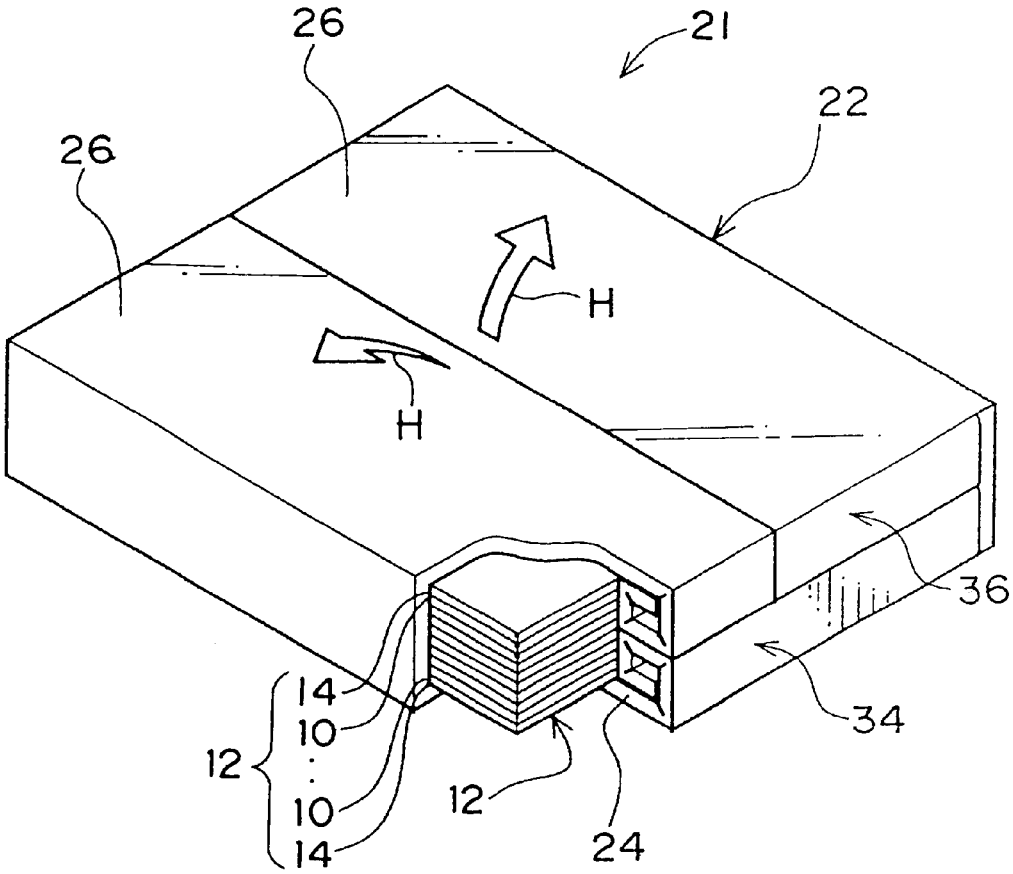
FIG. 4 is a perspective view illustrating a state in which a stacked sheaf using interleaf sheets is packaged in the packaging structure according to the first embodiment of the present invention, with a portion of a packaging box being cut away.

For example, as long as the planographic printing plates 10 that are fed manually are to be used in conditions in which non-removal of interleaf sheets does not occur, interleaf sheets 14 may be adhered to the image forming surfaces 10P of the planographic printing plates 10 and alternatingly disposed between the planographic printing plates 10 to form the stacked sheaf 12, as shown in packaging structure 21 in FIG. 4. In a structure in which the interleaf sheets 14 are used, if the image forming surface strength of the planographic plate is, as will be understood from Case 4 in Table 1, at least 490 Pa, then damage to the image forming surface 10P is reliably prevented. Of course, planographic printing plates 10 having an image forming surface strength of 980 Pa may also be stacked and packaged using the interleaf sheets 14. In this case, damage to the image forming surfaces 10P can be prevented even more effectively.

Figure 5:
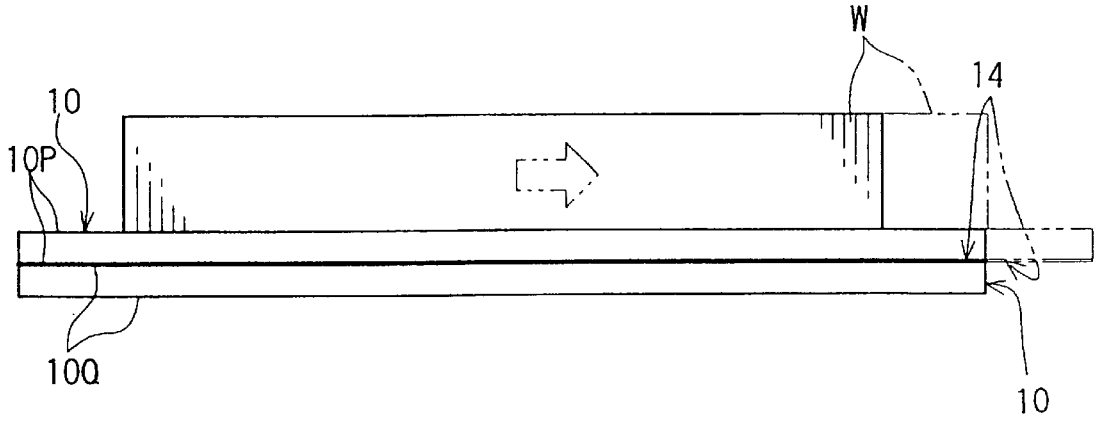
FIG. 5 is an explanatory view illustrating an instance in which, in the method for measuring strength of an image forming surface of a planographic plate of the present invention, a member that contacts the image forming surface of the planographic printing plate in a packaged state is an interleaf sheet.

Further, it is possible to appropriately select, in correspondence with the actual packaging structure for the planographic printing plates, the contact member in the method of the present invention. For example, when the stacked sheaf 12 of the planographic printing plates 10 is formed using the interleaf sheets 14, the interleaf sheet 14 may, as shown in FIG. 5, be disposed as the contact member in the method of the present invention, whereby a state more closely approximating actual conditions is created and the image forming surface strength can be measured. However, rigidity of the interleaf sheet 14 is often low, and it is sometimes difficult to contact the interleaf sheet 14 with the image forming surface 10P of the planographic printing plate 10 at an even pressure across the entire surface. Consequently, as will be understood from FIG. 5, it is preferable to place a planographic printing plate 10 (or a plate-shaped member having the same configuration as the interleaf sheet 14 when seen in plan view and a fixed rigidity) on the interleaf sheet 14, or to use as a weight W a member having a bottom surface that is the same as that of the interleaf sheet 14 when seen in plan view, and to contact the interleaf sheet 14 with the image forming surface 10P of the planographic printing plate 10 at an even pressure across the entire surface.

Figure 6:
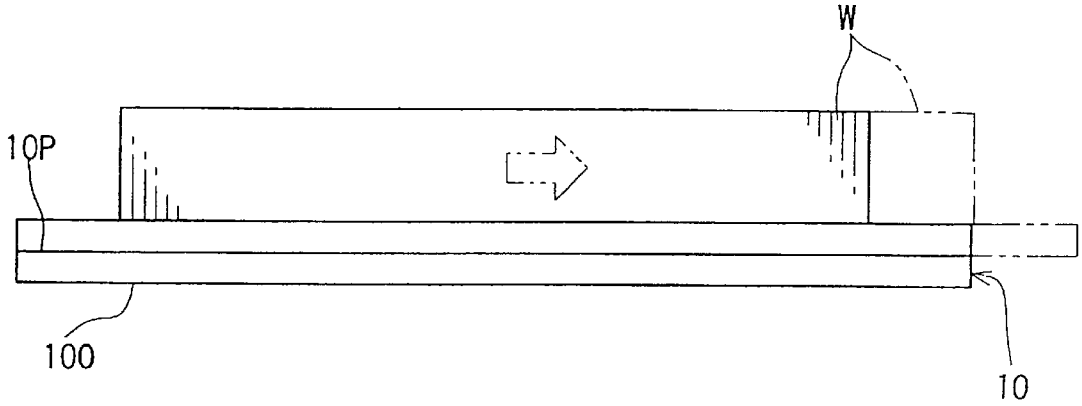
FIG. 6 is an explanatory view illustrating an instance in which, in the method for measuring strength of an image forming surface of a planographic plate of the present invention, a member that contacts the image forming surface of the planographic printing plate in a packaged state is protective cardboard.

There are also cases in which a protective cardboard (not shown; sometimes referred to as an abutment cardboard) is disposed at every predetermined number of planographic printing plates 10 or at ends of the stacked sheaf 12 in the direction in which the plates are stacked, whereby the planographic printing plates 10 are protected from external forces and damage to and deformation of the plates do not occur. Thus, as shown in FIG. 6, a protective cardboard may be disposed as the contact member in the method of the present invention, whereby a state more closely approximating actual conditions is created.

Description has been given of the packaging structure 20, in which the stacked sheaf 12 is packaged by the packaging box 22 shown in FIG. 1. However, the packaging structure of the present invention is not limited to the same. For example, a packaging structure 50 that uses a packaging box 52 having the configuration shown in FIG. 7 may also be employed.

The packaging box 52 comprises a main body 54, a bottom pad 56 disposed inside of the main body 54, and a cover panel 58 for closing the opening of the main body 54.

Figure 7:
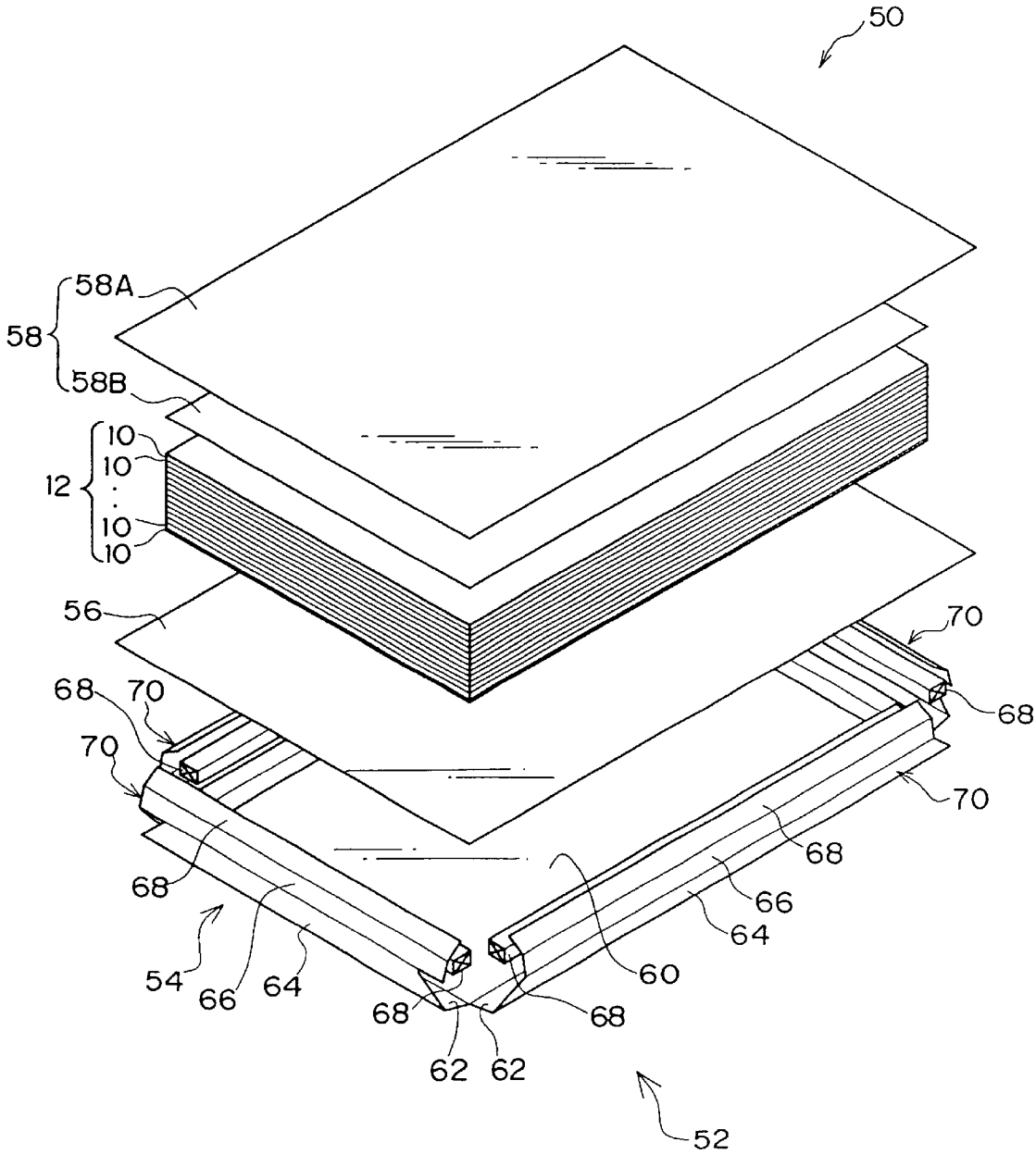
FIG. 7 is a perspective view illustrating a packaging structure for planographic printing plates according to a second embodiment of the present invention.
Figure 8:
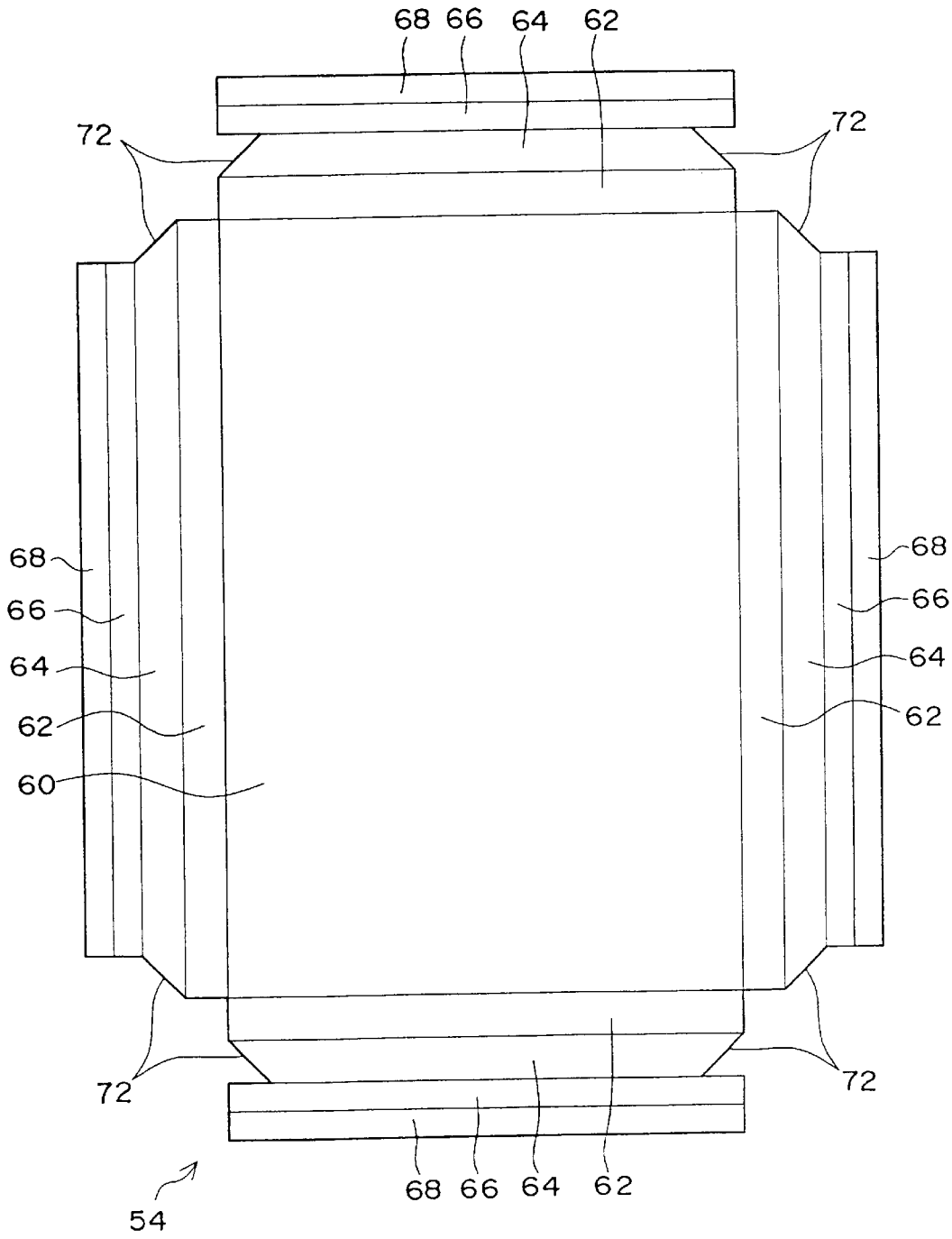
FIG. 8 is a development view illustrating a packaging box for the planographic printing plates that form the packaging structure according to the second embodiment of the present invention.

As shown in FIG. 8, the main body 54 of the packaging box 52 comprises side panels 62, top panels 64, and inner panels 66 and 68, which are formed continuously in this order from a bottom panel 60. As shown in FIG. 7, in a state in which the packaging box 54 is assembled, the side panels 62, the top panels 64 and the inner panels 64 are successively folded at right angles to form a spiral-like configuration. Core members 68 (i.e., the inner panels 68) are accommodated to the inside of the side panels 62, the top panels 64 and the inner panels 66, whereby reinforcements 70 are formed. The packaging box 52 is reinforced by the reinforcements 70, which serve to prevent unintentional folding or bending of the packaging box 52. Further, the cover panel 58 comprises a cover panel main body 58A adhered to a cover backing pad 58B. When the cover panel 58 closes the opening of the packaging box 54, the cover backing plate 58B is disposed to the inside of the reinforcements 70. It should be noted that ends of the top panels 64 in the lengthwise direction are notched at 45° to form sloping edges 72 for preventing the top panels 64 from overlapping.

Materials for the packaging boxes 22 and 52 are not particularly limited. However, by using packaging boxes 22 and 52 made of corrugated cardboard, for example, the packaging boxes can be made lightweight and at a low cost, and it becomes possible to easily obtain predetermined strength and rigidity. In addition to cardboard, other examples of materials that can be used include paper board, craft paper, honeycomb-structured material made of paper, and the like.

When corrugated cardboard is used, it is preferable that the following conditions are met from the standpoint of maintaining fixed strength.

The flutes of the cardboard are, in order of preference, A flute, C flute, B flute and E flute. The layer structure of the cardboard is, in order of preference, triple wall (e.g., AAA) cardboard, double wall (e.g., AA) cardboard and single wall (e.g., A) cardboard. Further, class of outer liner and inner liner of the cardboard are, in order of preference, AA class, A class, B class and C class. Weighing capacity of the outer and inner liners is preferably no less than 160 g/m$^2$ and no greater than 440 g/m$^2$. The type of core for the cardboard is, in order of preference, reinforced core, A class, B class and C class. Weighing capacity of the core is preferably no less than 100 g/m$^2$ and no greater than 280 g/m$^2$.

When using a honeycomb-structured material in place of cardboard, it is preferable for the material to have the same outer liner, inner liner and core as those described above for corrugated cardboard.

When using paper board in place of corrugated cardboard, it is preferable for the weighing capacity to be no less than 200 g/m$^2$ and no greater than 2000 g/m$^2$. (The higher the numeral values are for the weighing capacity of the outer liner, inner liner and core of the cardboard and honeycomb-structured material and the weighing capacity of the paper board, the higher the strength thereof becomes.)

In accordance with the type of planographic printing plate 10 used and the method of transportation therefor, the stacked sheaf 12 can be packaged in a packaging box, such as a cardboard box, and then loaded onto a loading member such as a pallet or skid (made of paper, resin or metal—the material therefor not being limited) to further facilitate handling. Also, depending on the type of planographic printing plate 10, the plates may be directly packaged in the packaging box, without being pre-packaged in the sheet-like paper, and loaded onto a pallet. In short, there are no particular limitations on the structure of the packaging member of the present invention, as long as the packaging member can package the stacked sheaf 12 of the planographic printing plates 10.

As described above, when the stacked sheaf 12 comprises 10 to 100 planographic printing plates 10, a fixing means such as adhesive tape may be used to prevent the planographic printing plates 10 and protective cardboards from sliding against each other. It is also possible to form a stacked sheaf 12 with even more planographic printing plates 10 to enable more efficient (with fewer number of times handled) transportation and storage. For example, roughly 3000 can be designated as a maximum number of planographic printing plates 10, and a protective cardboard can be inserted between every 20 to 100 planographic printing plates 10. Alternatively, roughly 1500 can be designated as a maximum number of planographic printing plates 10, and a protective cardboard can be disposed only at the top and bottom of the stacked sheaf 12.

By using the protective cardboards and adhesive tape, the planographic printing plates 10 can be more reliably protected. Even when the planographic printing plates 10 receive a large external force at the time of handling, it is possible to prevent the planographic printing plates 10 from sustaining damage and being deformed. However, even when the protective cardboards and adhesive tape are not used, the planographic printing plates 10 will not sustain damage or become deformed as long as care is taken so that a large external force is not applied to the planographic printing plates 10.

There are no particular limitations on the materials and physical properties of the protective cardboard as long as the cardboard can prevent the planographic printing plates 10 from being damaged or deformed. For example, there can be used a protective cardboard whose weighing capacity is 200 to 1500 g/m$^2$, whose density is 0.7 to 0.85 g/cm$^3$, whose moisture content is 4 to 8%, whose Bec smoothness is 3 to 20 seconds and whose pH is 4 to 6. Examples of materials that can be used for the protective cardboard include, but are not limited to, wood pulp, natural fiber such as hemp, synthetic pulp obtained from linear macromolecules such as polyolefine, and regenerated cellulose. These materials can be used singly or in combination. By selecting an inexpensive material such as wood pulp or natural fiber, the protective cardboard can be manufactured at a low cost. Specifically, for example, a protective cardboard can be used that has a density of 0.72 g/cm$^3$ and a weighing capacity of 640 g/cm$^2$. This protective cardboard is obtained by pulp-beating untreated paper, adding to the paper material diluted to a concentration of 4% a sizing agent so that the cardboard weight becomes 0.1% and adding to the same paper material a paper agent so that the cardboard weight becomes 0.1%, and then adding aluminum sulfate until the pH of the paper material is 5.0. In particular, it is preferable to use a protective cardboard having roughly 60 $\mu$m of low-density polyethylene laminated on both sides thereof for planographic printing plates 10 having a photosensitive layer, in order to prevent the photosensitive layer from decomposing due to the moisture content in the protective cardboard itself.

When the interleaf sheets 14 are used, there can be used, for example, paper comprising 100% wood pulp, paper comprising not exclusively 100% wood pulp but also synthetic pulp, and paper having a low-density polyethylene layer disposed on the surface thereof. Because the cost of materials for paper in which synthetic pulp is not used is low, the interleaf sheets 14 can be manufactured at a low cost by using paper in which synthetic pulp is not used. Specifically, there can be used an interleaf sheet that is made from bleached craft pulp and whose weighing capacity is 30 to 60 g/m$^2$, whose density is 0.7 to 0.85 g/cm$^3$, whose moisture content is 4 to 6%, and whose pH is 4 to 6. However, the composition of the interleaf sheet is not limited to the same.

What is claimed is:

1. A packaging structure for planographic printing plates, the structure comprising:

a plurality of planographic printing plates, each planographic printing plate including an image forming surface having a strength equal to or greater than 490 Pa when measured by a method for measuring strength of an image forming surface of a planographic printing plate, the method comprising the steps of:

contacting the image forming surface to be measured of the planographic plate with a member that is comparable to a predetermined member that will contact the image forming surface of the planographic printing plate when disposed in a packaged state, sliding at least one of the planographic printing plate including the image forming surface to be measured and the member relative to each other and in a direction along the image forming surface while a predetermined load is applied to the planographic printing plate and the member in a direction substantially orthogonal to the image forming surface, observing the planographic printing plate for damage to the image forming surface being measured, and determining a strength of the image forming surface of the planographic printing plate based on a maximum value of pressure that does not generate damage when applied to the image forming surface;

a stacked sheaf comprising protective members contacting the image forming surfaces for protecting the image forming surfaces of the planographic printing plates, the protective members and the planographic printing plates being alternately stacked; and a packaging member for storing and packaging the stacked sheaf.

2. The packaging structure of claim 1, wherein the strength of the image forming surface is equal to or greater than 980 Pa.

3. The packaging structure of claim 1, wherein the packaging structure is formed by the planographic printing plates being supplied by an automatic plate-feed mechanism.

4. The packaging structure of claim 2, wherein the packaging structure is formed by the planographic printing plates being supplied by an automatic plate-feed mechanism.

5. A method for measuring strength of an image forming surface of a planographic printing plate, the method comprising the steps of:

contacting the image forming surface to be measured with a member comparable to a predetermined member that will contact the image forming surface of the planographic printing plate when disposed in a packaged state;

sliding at least one of the planographic printing plate including the image forming surface to be measured and the member expected to contact the image forming surface of the planographic printing plate relative to the other and in a direction along the image forming surface while a predetermined load is applied to the planographic printing plate and the member in a direction substantially orthogonal to the image forming surface;

observing the planographic printing plate for damage to the image forming surface being measured; and determining a strength of the image forming surface of the planographic printing plate based on a maximum value of pressure that does not generate damage when applied to the image forming surface as.

6. The method of claim 5, wherein the member is a planographic printing plate identical to the planographic printing plate including the image forming surface to be measured.

7. A packaging structure for planographic printing plates, the structure comprising:

a plurality of planographic printing plates, each planographic printing plate including an image forming surface having a strength equal to or greater than 490 Pa when measured by a method for measuring strength of an image forming surface of a planographic printing plate, the method comprising the steps of:

contacting the image forming surface to be measured with a member expected to contact the image forming surface of the planographic printing plate in a packaged state, sliding at least one of the planographic printing plate including the image forming surface to be measured and the member relative to the other and in a direction along the image forming surface while a predetermined load is applied to the planographic printing plate and the member in a direction substantially orthogonal to the image forming surface, observing the planographic printing plate for damage to the image forming surface being measured, and determining a strength of the image forming surface of the planographic printing plate based on a maximum value of pressure that does not generate damage when applied to the image forming surface;

a stacked sheaf, in which surfaces of the planographic printing plates are in direct contact; and a packaging member for storing and packaging the stacked sheaf.

8. The packaging structure of claim 7, wherein the strength of the image forming surface is equal to or greater than 980 Pa.

9. The packaging structure of claim 7, wherein the packaging structure is formed by the planographic printing plates being supplied by an automatic plate-feed mechanism.

10. The packaging structure of claim 8, wherein the packaging structure is formed by the planographic printing plates being supplied by an automatic plate-feed mechanism.

11. The packaging structure of claim 7, wherein the image forming surface of the planographic printing plate comprises a recording layer whose solubility in developer is altered by irradiation with laser light.

12. The packaging structure of claim 8, wherein the image forming surface of the planographic printing plate comprises a recording layer whose solubility in developer is altered by irradiation with laser light.

13. The packaging structure of claim 9, wherein the image forming surface of the planographic printing plate comprises a recording layer whose solubility in developer is altered by irradiation with laser light.

14. The packaging structure of claim 10, wherein the image forming surface of the planographic printing plate comprises a recording layer whose solubility in developer is altered by irradiation with laser light.

* * * * *